US006224054B1

(12) United States Patent
Shimura et al.

(10) Patent No.: US 6,224,054 B1
(45) Date of Patent: May 1, 2001

(54) SHEET STORAGE APPARATUS WITH SHEET CURL CORRECTION

(75) Inventors: Makoto Shimura; Masato Hosaka, both of Yamanashi-ken (JP)

(73) Assignee: Nisca Corporation, Yamanashi-ken (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/999,034

(22) Filed: Dec. 29, 1997

(30) Foreign Application Priority Data

Dec. 28, 1996 (JP) ..... 8-359203

(51) Int. Cl.[7] ..... B65H 39/10

(52) U.S. Cl. ..... 271/293; 271/288; 270/58.07; 270/58.09

(58) Field of Search ..... 270/58.08, 58.09, 270/58.07; 271/292, 293, 294, 220, 288

(56) References Cited

U.S. PATENT DOCUMENTS

| | | | | |
|---|---|---|---|---|
| 4,087,087 | * | 5/1978 | Looney | 271/220 X |
| 4,621,803 | | 11/1986 | Johdai et al. | 270/58.08 |
| 4,787,616 | * | 11/1988 | Sasaki et al. | 271/294 X |
| 4,986,520 | | 1/1991 | Shido et al. | 271/293 |
| 5,131,644 | * | 7/1992 | DuBois | 271/220 X |
| 5,382,016 | * | 1/1995 | Kobayashi et al. | 271/293 |
| 5,603,492 | * | 2/1997 | Mandel et al. | 270/58.09 |
| 5,722,030 | * | 2/1998 | Kato | 271/293 X |
| 5,761,600 | * | 6/1998 | Murata | 271/292 X |

FOREIGN PATENT DOCUMENTS

| | | |
|---|---|---|
| 62200288 | 2/1989 | (JP) . |
| 08048458A | 2/1996 | (JP) . |

* cited by examiner

*Primary Examiner*—Christopher P. Ellis
*Assistant Examiner*—Patrick Mackey
(74) *Attorney, Agent, or Firm*—Pitney, Hardin, Kipp & Szuch LLP

(57) ABSTRACT

In a sheet storage apparatus having a plurality of bin trays for stacking sheets fed sequentially from an image forming device into sheaves of sheets, sheet accommodating spaces formed on the respective bin trays for receiving the sheets fed from the image forming device are made wide at a sheet intake position so as to successfully introduce the sheets thereinto and narrow at the positions above and below the sheet intake position so as to effectively store the sheets. When the sheets introduced into the sheet accommodating space at the sheet intake position comes to a prescribed number or height, the bin trays are moved upward or downward to narrow the sheet accommodating spaces, thus to compress a bulky stack of sheets. When taking out the finished sheaves of sheets from the apparatus, the sheet accommodating spaces formed between the bin trays are made relatively wide.

7 Claims, 10 Drawing Sheets

FIG. 7F (5π)
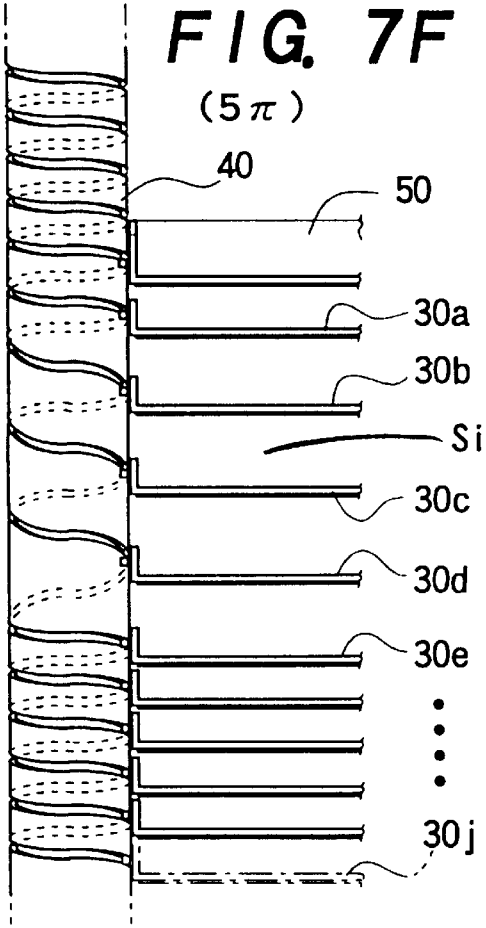
FIG. 7E (4π)
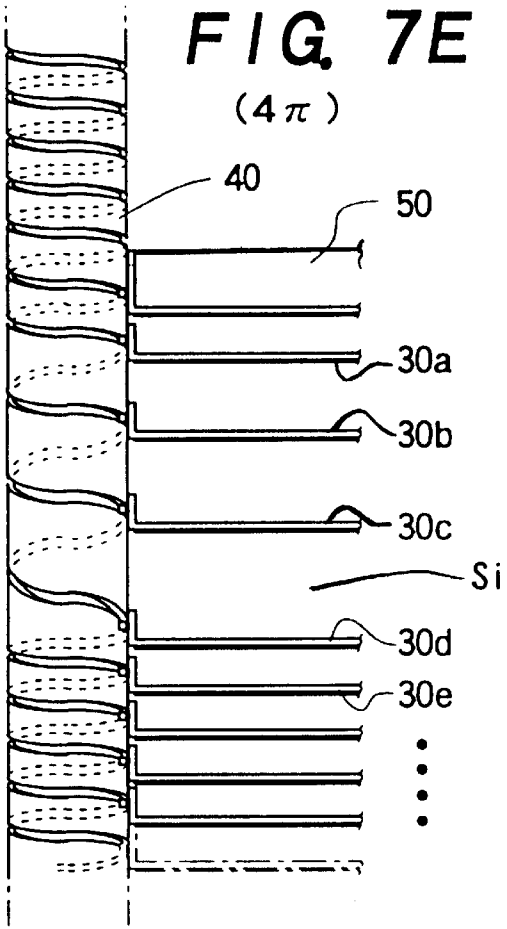
FIG. 7D (3π)
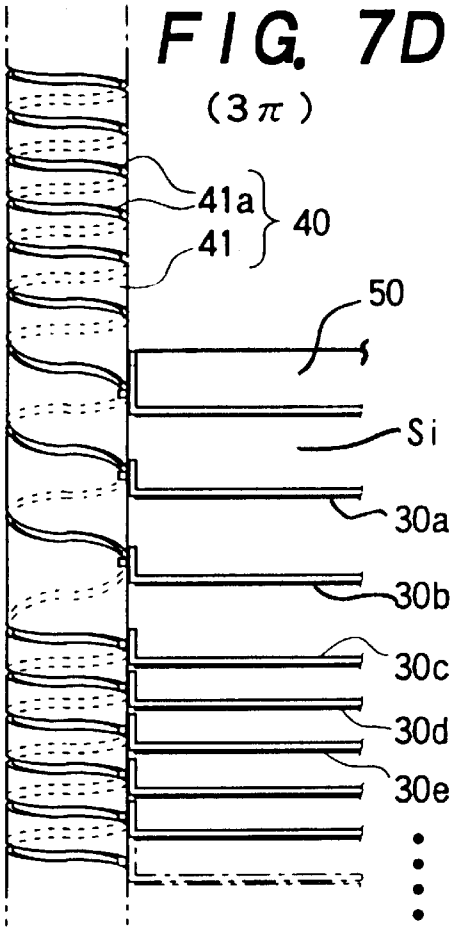

70a
sB
40
41a
41

Lu
30a
30b
30c
50
21
Lm
30j
TP
Ld
30
Si
20
70b

30B
HR
30A
a3
F
32
20

30B
a4
20
HR
30A
F
32

SHEET STORAGE APPARATUS WITH SHEET CURL CORRECTION

BACKGROUND OF THE INVENTION

1. Field of the Invention

This invention relates to an apparatus with Sheet Curl Correction for storing one or more recorded sheets discharged from an image forming device such as a copying machine, and more particularly to a sheet storage apparatus having a mechanism capable of rationally operating a plurality of bin trays vertically juxtaposed to form accommodating spaces therebetween and widening the sheet accommodating space into which the recorded sheet fed from the image forming device is introduced.

2. Description of the Prior Art

The so-called "sorter" has been used for sorting recorded sheets discharged consecutively from an image forming device such as a copying machine, printer and facsimile into a sheaf or sheaves of sheets. Also, there have been a sheet post-processing apparatus and a finishing apparatus having functions of not only sorting the recorded sheets from the image forming device, but also stapling or punching the sorted sheets on demand. Every sheet handling apparatus of this kind is provided with a plurality of bin trays for receiving the recorded sheets fed from the image forming device one by one to make more than one sheaf of recorded sheets.

The closer the bin trays get to the adjacent bin trays, the larger the number of the bin trays becomes in a limited extent. That is, the capacity of storing the recorded sheets can be increased with narrowing the distance between the adjacent bin trays. However, as a sheet accommodating space defined between the vertically adjacent bin trays is narrowed by bringing the bin trays close to the adjacent one, it becomes difficult to introduce the recorded sheets from the image forming device into the sheet accommodating space and take out the finished sheaves of recorded sheets from the sheet accommodating space, and furthermore, the number of sheets which are permitted to be stacked on the respective bin trays is restricted.

For the purpose of mitigating the drawbacks described above, there have been so far proposed various mechanisms for widening a sheet accommodating space formed between the bin tray for stacking the recorded sheet and the overhead bin tray placed immediately thereabove at the time of introducing the recorded sheet from the image forming device thereinto. For instance, U.S. Pat. Nos. 4,986,520 and 4,621,803 are adduced.

A sorter described in U.S. Pat. No. 4,986,520 comprises a bin slider containing a plurality of multistage bins, which moves vertically to place the specified one of the bins at a sheet intake portion through which the sheet is admitted into a sheet accommodating space defined on the specified bin. In this known sorter, the sheet accommodating space for receiving the sheet is widened by using short lead cams. The conventional sorter serves to widen only the sheet accommodating space for receiving the sheet, but it is disadvantageous in that the bin slider containing the bins as noted above is complicated in structure and large in size, and it is difficult to actuate the lead cams synchronously with the bin slider.

Another sorter described in U.S. Pat. No. 4,621,803 is provided with bin shifting means composed of a pair of lead cam shafts for widening only a sheet accommodating space formed between adjacent bins at a sheet intake position.

However, the bins in this conventional sorter are immovably held at their ends by support plates, and thus, render taking-out of the sheaves of sheets from the sheet accommodating spaces difficult because it is impossible to widen sheet outlet openings formed at the terminal ends of the bins. If the sheet outlet openings are made larger to facilitate the taking-out of the sheets from the accommodating spaces, the sorter is increased in size.

Furthermore, neither of the conventional sorters can cope with unexpected accident possibly resulting from the peculiar properties of the sheet to be handled or various conditions in which the sorter is operated. To be more specific, for example, in a typical image forming device such as a copying machine, a copying paper sheet is by and large curled or wraped as the result of being heated to fix a toner image with heat. Consequently, the conventional sorters are susceptible to sheet feeding troubles such as interference of the curled or wraped sheets, resulting in jamming or misalignment of the sheets stacked on the bin, but could not prevent such troubles. Moreover, since the conditions in which the sheet should be introduced from the image forming device into the sorter are affected by the thickness and properties of the sheet to be handled or other possible causes, they cannot be nonambiguously determined.

In a different sorter described in Japanese Patent Application Public Disclosure HEI 8-48458, in a case where a concavely curled sheet with its middle portion curved downward is fed from an image forming device, a sheet stacking bin holding the curled sheet thereon is moved upward so as to press the curled sheet against the lower surface of an overhead bin immediately above the sheet stacking bin in expectation of straightening the curled sheet. The sheet fed from the image forming device is, however, not always curled concavely, and there are times when it is curled convexly according to circumstances. Therefore, even though the sheet curled concavely or convexly is intended to be cured in the same manner of moving the sheet stacking bin upward, the curled sheet cannot necessarily be cured desirably.

Besides, there is a case where the sheet sent from the image forming device is not successfully released from intake rollers mounted at a sheet intake portion of the sorter, consequently causing the sheets stacked on the bin to be inconveniently disordered or jammed. The conventional sorters as noted above are not free from nor can remedy such disadvantages.

Incidentally, it is desired for the sheet sorting apparatus of this kind to align and compress the recorded sheets given from the image forming device and stacked on a stacking bin tray pertinently according to two processing modes, i.e. a non-sorting mode in which one sheaf of sheets is obtained without sorting, and a sorting mode in which two or more sheaves of sheets are obtained by sorting.

Additionally, when the sheaves of sheets are taken out from the sorting apparatus, it is required to make the sheet accommodating spaces wider than during the sheet being sent thereinto so as to take out the sheaves of sheets with ease. As a matter of course, simplicity in structure and easiness in handling are indispensable to the sorting apparatus of this kind.

OBJECT OF THE INVENTION

An object of the present invention is to provide a sheet storage apparatus capable of efficiently sorting a plurality of sheets into sheaves of sheets and automatically aligning and bookbinding the sheaves of sheets with a staple or staples on demand.

Another object of the present invention is to provide a sheet storage apparatus capable of automatically sorting and aligning sheets to obtain one sheaf of sheets in a non-sorting mode, and two or more sheaves of sheets in a sorting mode with high efficiency, and facilitating taking-out of finished sheaves of sheets.

Still another object of the present invention is to provide a sheet storage apparatus which is simple in structure and handling and has an efficient function of aligning even a large number of sheets and compressing a bulky stack of sheets into a compact sheaf of sheets.

Yet another object of the present invention is to provide a sheet storage apparatus capable of adequately curing a stack of curled sheets in accordance of the properties and stacking conditions of sheets, and assuredly introducing and stacking the sheets in position on a bin tray even when the sheet is not successfully released from sheet intake rollers positioned at a sheet introducing portion of the apparatus.

SUMMARY OF THE INVENTION

To attain the object described above according to this invention, there is provided a sheet storage apparatus comprising a sheet introduction means for admitting in sheets discharged from an image forming device, a plurality of vertically movable trays for storing the sheets from the image forming device, which are juxtaposed vertically to define sheet accommodating spaces therebetween, and means for vertically moving the trays so as to widen the sheet accommodating space defined on the tray confronting the sheet introduction means.

The tray moving means includes a pair of lead cams each having one spiral thread guide groove, which are disposed astride the vertically juxtaposed trays. With rotation of the lead cams, the trays move vertically along the spiral thread guide grooves of the lead cams. Each tray is positioned so as to be vertically separated from the adjacent trays at intervals of one pitch of the spiral thread guide groove of the lead cam, thus forming the sheet accommodating space between the tray confronting the sheet introduction means for receiving the sheet fed from the image forming device and the overhead tray immediately thereabove.

The spiral thread guide groove formed in the lead cam is made wider in pitch at its substantially midsection faced to a sheet introducing portion at which the sheet introduction means is disposed so that the sheet accommodating space formed at the sheet introducing portion is widened, thus to easily and stably send the sheet from the image forming device into the wide sheet accommodating space.

The spiral thread guide groove varies in pitch so that the sheet accommodating spaces between the adjacent bin trays can be made wide sufficiently to easily take out the finished stacks of sheets therefrom.

The spiral thread guide groove in the lead cam is made narrow in pitch the upper and lower sections above and below the midsection including at the sheet introducing portion. When the sheets sent into the sheet accommodating space at the sheet introducing portion are increased in number or curled sheets are received, the trays including the sheet receiving tray on which the sheets are stacked are moved upward or downward by rotating the lead cams so that the sheet accommodating space holding the stacked sheets is narrowed to compress the sheets stacked therein or cure the curled sheets. To continue receiving succeeding sheets from the image forming device, the tray on which the sheets thus compressed are stacked is moved back to the sheet introducing portion by driving the lead cams.

A space restriction member is disposed immediately above the uppermost tray by one pitch of the lead cam, so as to form a sheet accommodating space between itself and the uppermost tray, which serves to compress sheets stacked on the uppermost tray likewise for the sheet accommodating spaces formed on the lower trays.

The apparatus is further provided with an aligning rod which is movable laterally and penetrated through all the vertically arranged trays. By moving the aligning rod horizontally toward the sheets stacked on the trays, the sheets stacked on each tray are pressed against one side wall piece of the tray to true up the lateral edges of the sheets stacked thereon. The stacked sheets thus aligned may be bound with at least one staple on demand.

Other objects and features of the present invention will be hereinafter explained in detail with reference to the accompanying drawings.

BRIEF DESCRIPTION OF THE DRAWINGS

FIG. 7A through FIG. 7F are schematic diagrams explanatory of the operation of the bin trays movable with rotation of the tray moving means shown in FIG. 6.

FIG. 11A and FIG. 11B are side views schematically showing the bin trays being moved in accordance with the properties of the sheets to be dealt with.

DESCRIPTION OF THE PREFERRED EMBODIMENTS

Figure 1:
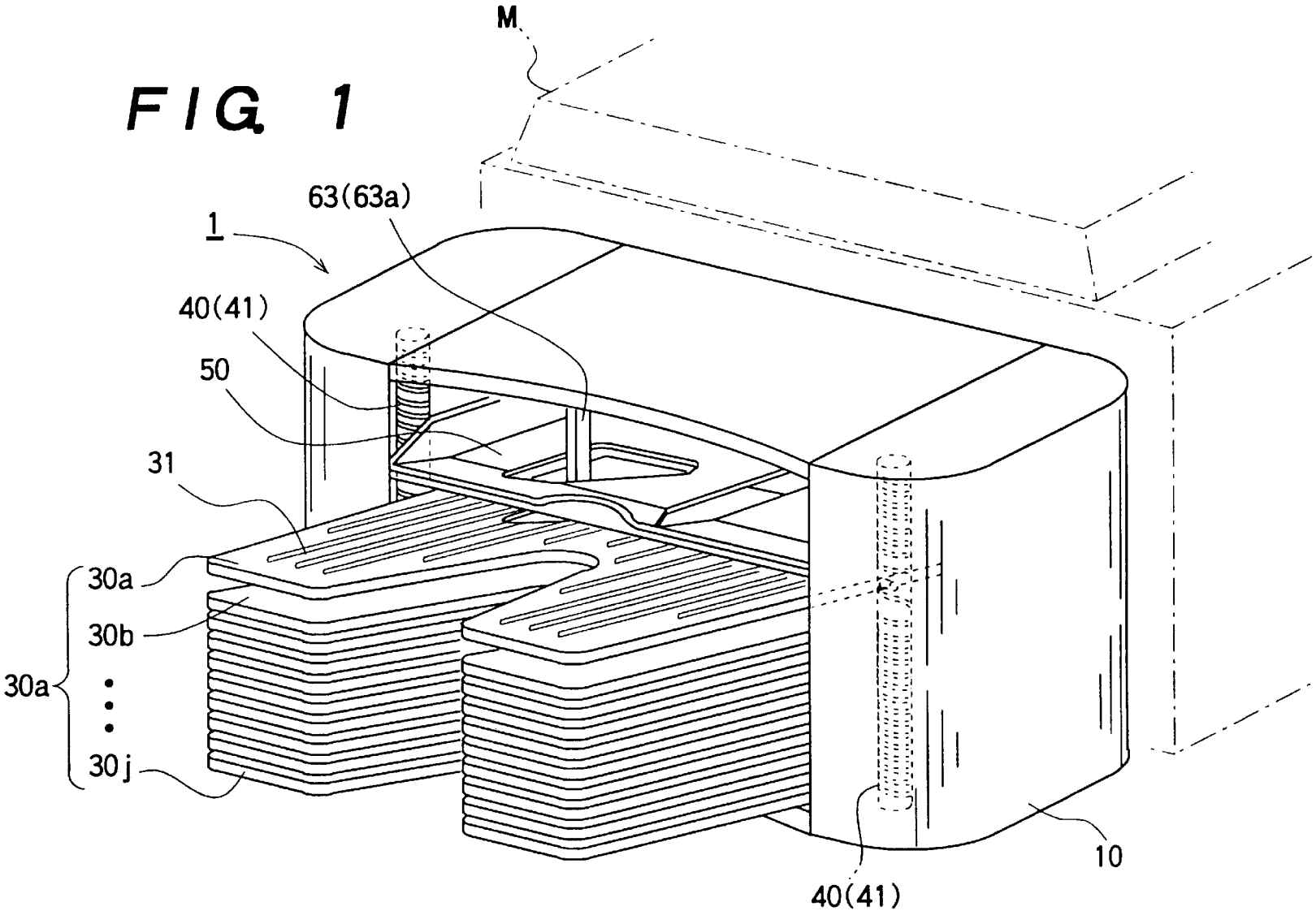
FIG. 1 is a perspective view schematically showing one embodiment of a sheet storage apparatus according to this invention.

This invention relates to a sheet storage apparatus for sorting sheets discharged from various types of image forming devices into a sheaf or sheaves of sheets and binding the sorted sheaf or sheaves with at least one staple on demand. The sheet storage apparatus of the invention is applied to the image forming device such as a copying machine, printer, facsimile, and printing press, from which copied, recorded or printed sheets are consecutively discharged.

Although the embodiment shown in FIG. 1 through FIG. 5 is illustrated as being attached to the copying machine M, the kind of the image forming device to which the sheet storage apparatus 1 of the invention is applied should not be understood as limitative. The apparatus of the invention may be applied to all kinds of sheet handling devices.

As illustrated, the sheet storage apparatus 1 of the invention comprises a housing 10 having a sheet intake port 10*a* confronting a sheet discharge portion D (including discharge rollers R) through which recorded sheets s are consecutively sent out one by one from the image forming device M, a sheet introduction means 20 including a sheet guiding member 21 and sheet intake rollers 22, a plurality of vertically movable bin trays 30 for stacking or storing the recorded sheets s, and means 40 for vertically moving the bin trays 30.

The illustrated embodiment includes ten bin trays 30*a*–30*j* juxtaposed vertically, but the number of the bin trays is not specifically limited. The apparatus of the invention may include at least one bin tray.

The bin tray 30 is provided on its both sides with sliding rollers 34 which are slidably fitted in guide slots 12 formed in parallel in the opposed inside walls of the housing 10. Thus, the bin trays are supported movably in the vertical direction along the guide slots.

The bin tray 30 has a sheet stacking plane 31 inclined toward its rear end faced to the sheet intake port 10*a*. The sheet stacking plane 31 is provided at its rear end with a rear aligning step 32, so that the sheets stacked on the bin tray slip down by their own weight along the stacking plane toward the rear aligning step 32, thus to be aligned exactly at their tail ends.

Since the bin tray 30 is held on its both side by the guide means composed of the sliding rollers 34 and guide slots 12 as touched on earlier, it can move vertically in parallel along the guide means without changing its slanting posture.

The shape of the sheet stacking plane 31 of the bin tray 30 is not specifically limited, but each bin tray 30 is slightly bent downward as illustrated. The bin trays have the same shape so as to be closely superposed vertically over one another. Practically, the bin trays 30 are slightly separated from one another with gaps (sheet accommodating spaces including a sheet intake space formed at a sheet intake position) left therebetween.

The bin tray 30 is provided on the middle portions of both sides thereof with sliding pins 35. The sliding pins 35 extending laterally from the bin trays 30*a*–30*j* are located in line vertically when the bin trays are put on top the other along the guide slots 12 arranged vertically in parallel.

The tray moving means 40 in this embodiment comprises lead cams 41 disposed on both sides of the bin trays 30 so as to confront the sliding pins 35 extending from the bin trays 30*a*–30*j* and arranged in vertical line, and rotational driving means 42 including a pulse motor 42*a* for rotating the lead cams 41 at a constant speed.

The lead cam 41 is positioned between the pair of guide slots 12 disposed on the both sides of the bin trays. The lead cam is not absolutely stood vertically, but it is preferable to arrange the lead cam vertically parallel to the guide slots 12 as illustrated. The lead cam 41 may be made substantially equal in length to the guide slot 12. Thus, the extent (Lmax in FIG. 6) in which the bin tray 30 is permitted to move vertically is limited by the vertical length of the lead cam 41 or guide slot 12.

The lead cam 41 is shaped in a round rod and provided in its circumferential surface with a single thread of spiral guide groove 41*a* into which the sliding pins 35 of the bin trays 30*a*–30*j* are slidably fitted. Thus, the bin trays 30 are moved vertically with the rotation of the lead cams 41 while sliding the sliding pins 35 of the bin trays along the spiral thread guide groove 41*a*. Since the sliding pins 35 arranged vertically in line on one side of the bin trays are fitted into the thread guide groove 41*a* every pitch, the bin trays 30*a*–30*j* are separated from the vertically adjacent trays at intervals equal to the pitch distances of the thread guide groove 41*a*.

The spiral thread guide groove 41*a* of the lead cam 41 is made relatively narrow in the upper section (Lu in FIG. 6) and lower section (Ld) at substantially regular intervals, and relatively wide in the midsection (Lm) at irregular intervals.

That is to say, the sheet accommodating space defined by the interval (corresponding to the pitch Pu or Pd) between the adjacent bin trays located in the upper section Lu or lower section Ld is designed to the thickness of the intended maximum number of sheets to be stored on the bin tray 30.

Figure 6:
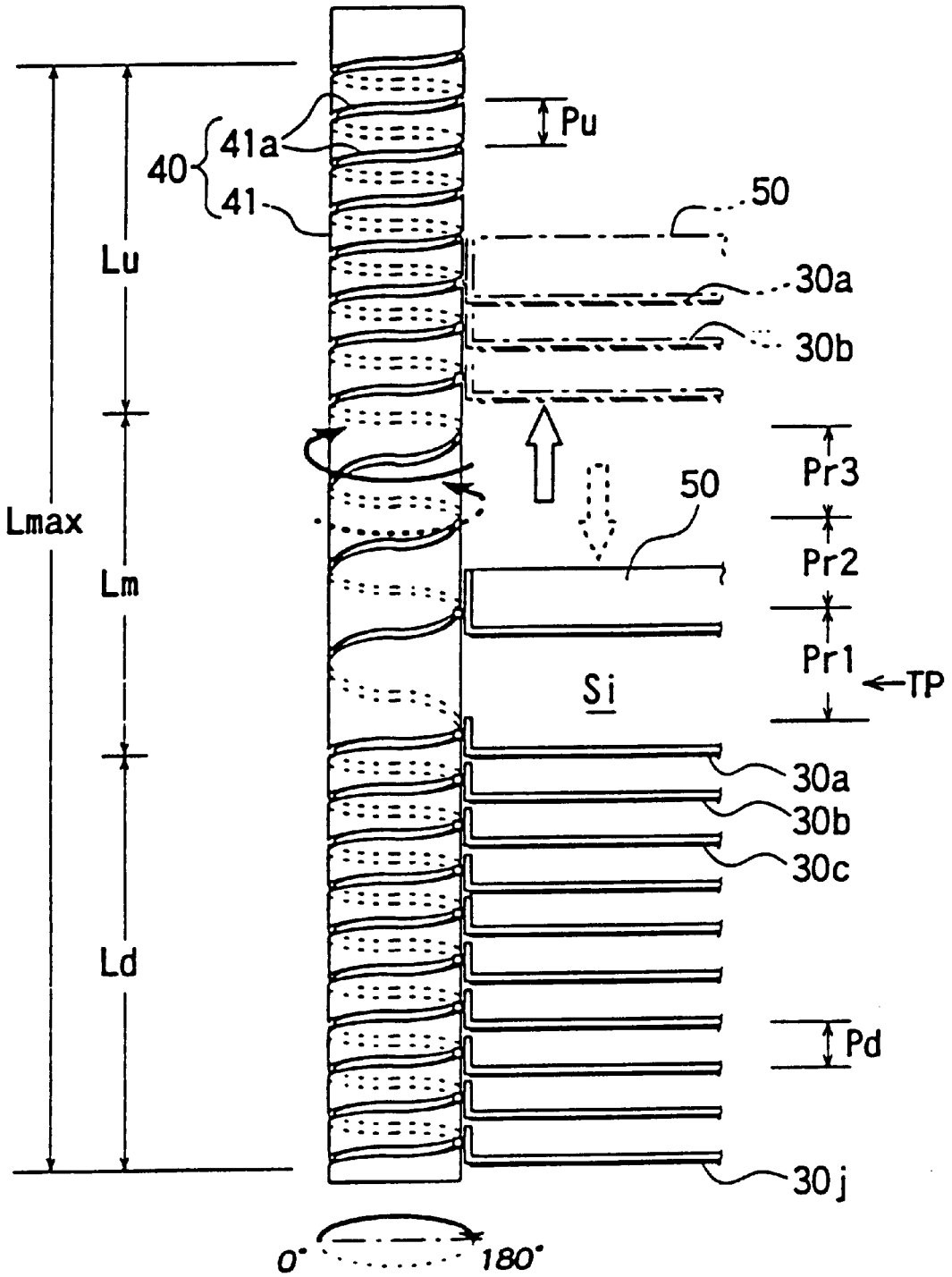
FIG. 6 is a schematic diagram explanatory of the operation of means for vertically moving the bin trays in the apparatus of FIG. 1.

The sheet accommodating space formed in the midsection Lm varies each time the lead cam 41 makes a half turn. Namely, the spiral thread groove of the lead cam 41 on the left side (0° phase) in FIG. 6 is formed at the substantially same pitch in Po1–Po4, and the spiral thread groove on the right side (180° phase) in FIG. 6 is formed at variable pitch in Pr1–Pr3. To put it concretely, the lower pitch Pr1 is made larger to form the sheet intake space Si at a sheet intake position TP.

Thus, by rotating the lead cams 41 to move the bin trays along the spiral thread grooves 41*a* having the irregular pitches, the bin trays move vertically at relatively low speed in the same direction in the upper section Lu and lower section Ld of the lead cam 41, and they move vertically at relatively high speed in the midsection Lm.

Each time the lead cam makes a half turn, the posture of the lead cam 41 is recognized by a detector 43 for detecting the rotational angle of the lead cam, which is mounted on a driving shaft 41*b* of one of the lead cams 41. The rotational angle detector 43 comprises light blocking members 43*a* projecting outward from the opposite sides of the driving shaft 41*b* of the lead cam 41, and a photo interrupter 43*b* which performs on-off switching operation according to movement of the light blocking members 43*a*. That is, the 0° and 180° rotations of the lead cam 41 can be precisely identified as the photo interrupter 43*b* detects the light blocking members 43*a* each time the lead cam 41 makes a half turn.

The rotational driving means 42 in this embodiment includes a pulse motor 42*a* which executes angular rotational motion in response to each of the electrical pulses supplied thereto, and means 42*b* for transmitting the rotation from the motor 42*a* to the driving shaft 41*b* of the lead cam 41. By counting the number of the electrical pulses given to the pulse motor in the driving means 42, the respective vertical positions of the bin trays 30*a*–30*j* which move vertically in concert with the rotating lead cams 41 can be precisely measured with the aid of the rotational angle detector 43.

In this embodiment, there is further disposed a space restriction member 50 above the uppermost tray 30*a* by one pitch of the lead cam 41. The space restriction member 50 moves vertically in synchronism with the vertically moving bin trays 30*a*–30*j* with the rotation of the lead cams 41. The space restriction member 50 forms a sheet accommodating space between itself and the uppermost tray 30*a* similarly to the bin trays.

Figure 5:
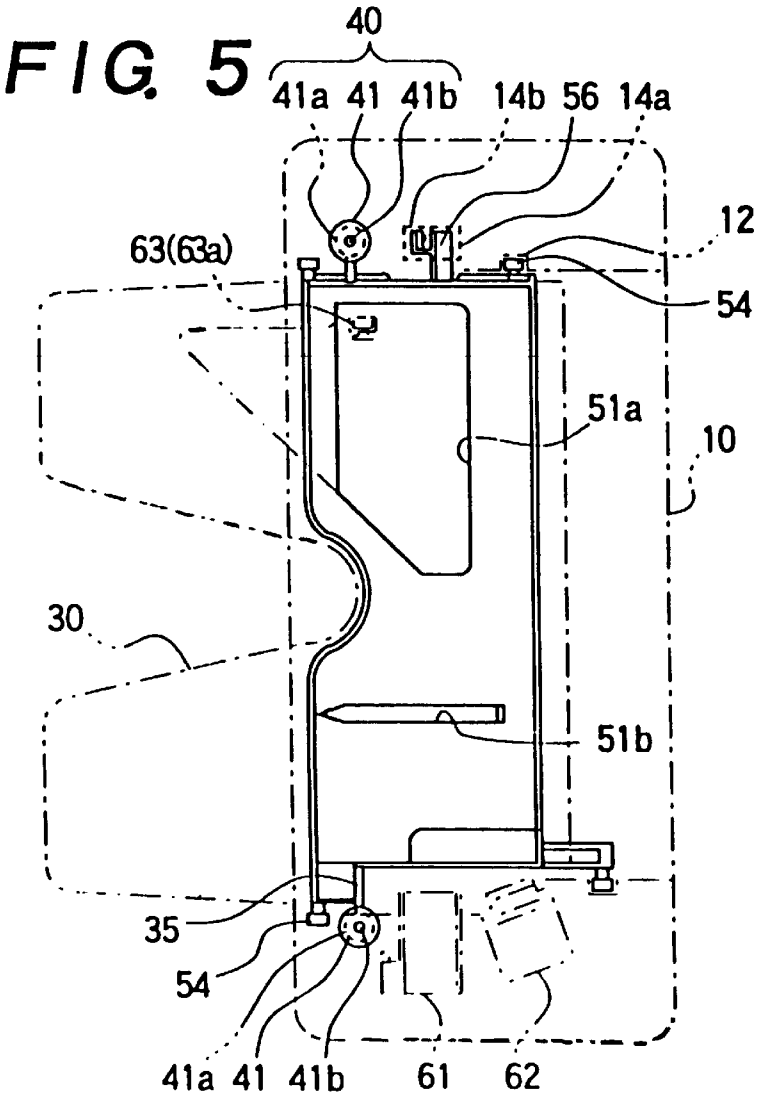
FIG. 5 is a plan view showing a space restriction member in the apparatus of FIG. 1.
Figure 4:
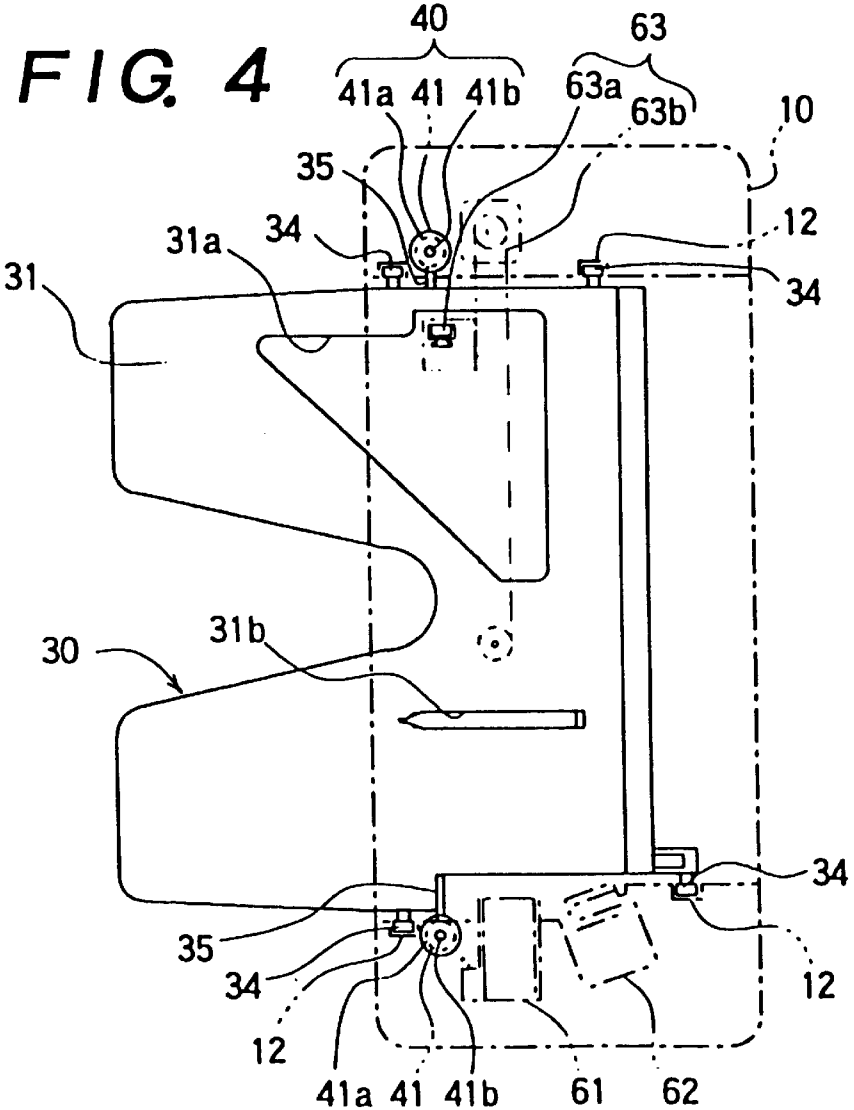
FIG. 4 is a plan view showing a bin tray in the apparatus of FIG. 3.

As shown in FIG. 5, the space restriction member 50 has a through hole 51*a* and a slot 51*b* analogous to through holes and slots formed in the bin trays 30, and pairs of sliding rollers 54 on both sides. The sliding rollers 54 are slidably fitted in the guide slots 12 formed in parallel in the opposed inside walls of the housing 10, so that the space restriction member can move upward and downward.

Figure 2:
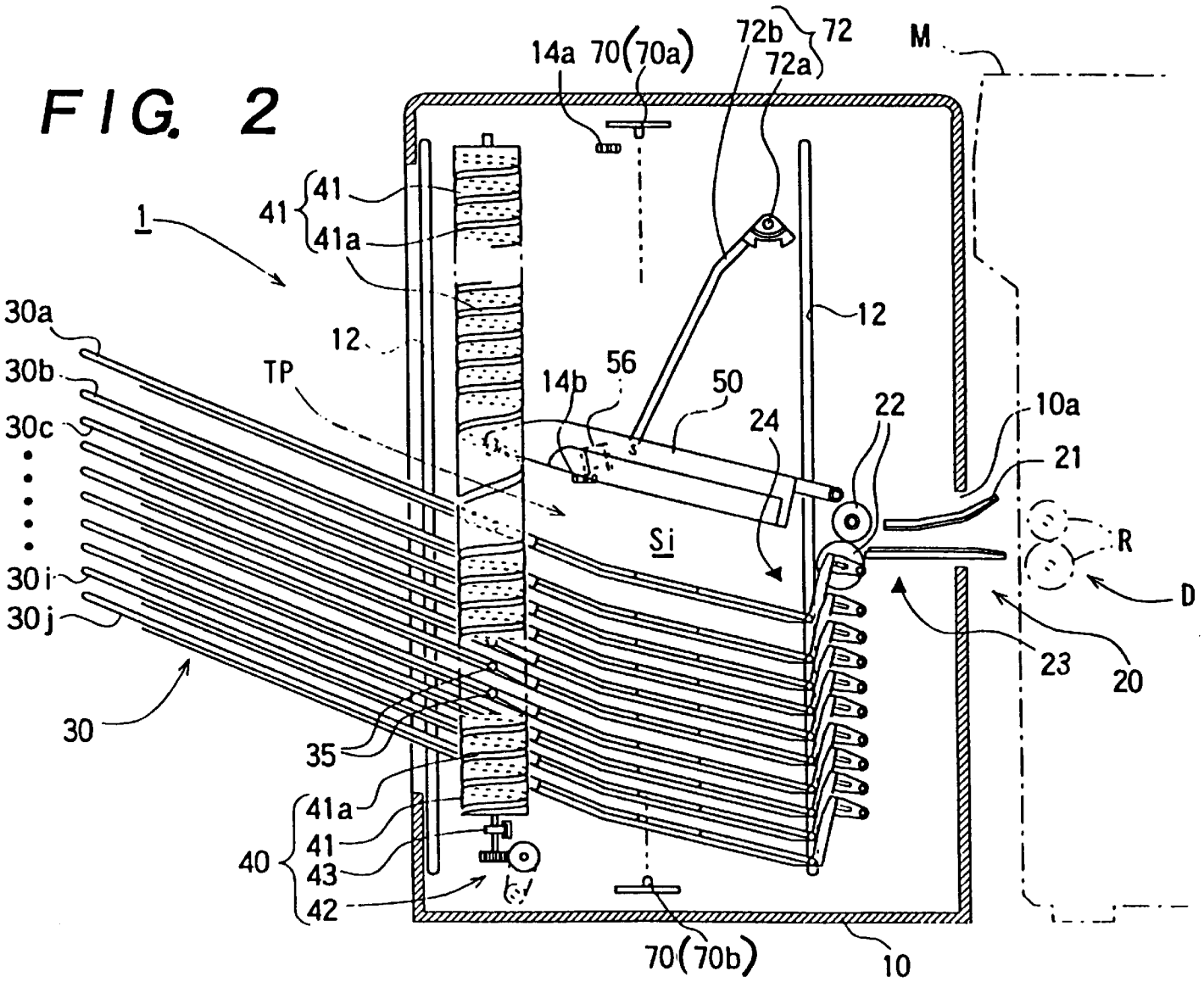
FIG. 2 is a front section schematically showing the apparatus of FIG. 1.

The space restriction member 50 is further provided on its one side with home-position detecting means 56 formed of an upper limiter 14*a* and a lower limiter 14*b* which are secured on the housing 10, so as to find the upper limit position and lower limit position of the space restriction member 50. Incidentally, when the space restriction member 50 is positioned at the lower limiter 14*b* as shown in FIG. 2, the uppermost bin tray 30*a* confronts the sheet intake position TP to form the widest sheet intake space Si thereon.

The apparatus of this embodiment further has functions of aligning the sheets stacked on the bin tray in the width direction and binding the sheets with at least one staple. The aligning and binding functions are fulfilled by use of sheet drawing means 61 and an electromotive stapler 62. The sheet drawing means is disposed on one lateral side of the sheet intake position TP (sheet intake space Si) faced to the sheet intake rollers 22. In addition to these elements, there is disposed sheet aligning means 63 for pressing the sheets stacked on the bin trays toward the sheet drawing means 61.

Figure 3:
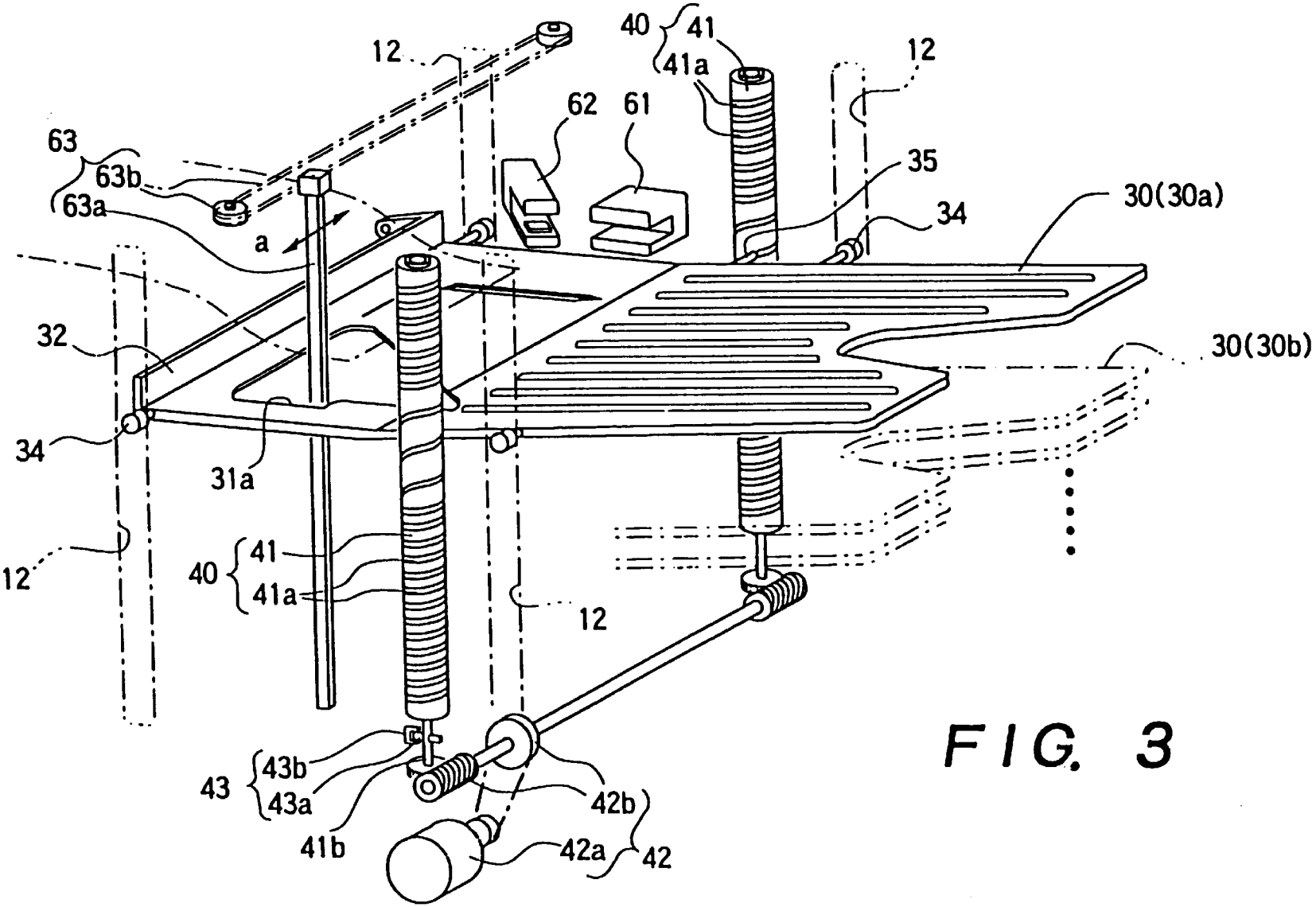
FIG. 3 is a perspective view schematically showing in part a bin tray unit and a driving mechanism in the apparatus of FIG. 1.

The sheet aligning means 63 comprises an aligning rod 63*a* penetrating the through holes 31*a* formed in the bin trays, and trailing means 63*b* including driving wheels and a timing belt for moving the aligning rod 63*a* in the width direction (indicated by the arrow a in FIG. 3).

As the sheet aligning means 63 is operated in such a state that the sheets are stacked on the bin trays, the trailing means 63*b* is actuated to move laterally the aligning rod 63*a* toward a lateral side aligning face defined in the sheet drawing means 61, thus to true up the lateral edges of the sheets.

Since the aligning rod 63*a* is penetrated through all the bin trays, the sheets stacked on the bin trays are simultaneously aligned in one operation with the aid of the sheet drawing means 61.

The stack of sheets on the bin tray is pushed in the lateral direction by the aligning means 63 while being pulled by the sheet drawing means 61, so that the lateral edges of the sheets are aligned at the lateral side aligning face defined inside the sheet drawing means 61, and thereafter, may be bound with one or more staples by use of the stapler 62 on demand.

The sheet storage apparatus of the invention is further provided with a sensor 70 for detecting the sheet or sheets existing on any of the bin trays. The sensor is generally composed of a pair of light emitting element 70*a* and light sensing element 70*b*, which are located at the upper and lower portions inside the housing 10. When light emitted from the light emitting element 70*a* reaches the light sensing element 70*b* through the slots 31*b* bored in the bin trays 30*a*–30*j*, the absence of sheet on any bin tray can be found. If at least one sheet exists on any of the bin trays, the light from the light emitting element 70*a* does not arrive at the light sensing element 70*b*. Thus, the existence of sheet on the bin trays can be recognized.

The aforementioned optical sheet sensor formed of the light emitting element 70*a* and light sensing element 70*b* may be replaced with a lever type sheet sensor 72 as shown in FIG. 2. Of course, these optical and mechanical sheet sensors may be used together. The sheet sensor 72 has a lever 72*b* swingably rotatable around an axis 72*a*, which is inserted in the slots 31*b* bored in the bin trays 30*a*–30*j*. With the movement of the lever 72*b* around the axis 72*a*, the existence of sheet stacked on the bin tray can be ascertained.

Next, the operation of the sheet storage apparatus 1 having the aforenoted structure will be explained.

In a case that the recorded sheets fed from the image forming device M are bound into one sheaf, sorting is unnecessary (non-sorting mode). In this non-sorting mode, the sheets consecutively discharged from the image forming device M through the sheet discharge portion D are successively introduced into the sheet intake space Si formed on the uppermost (first) bin tray 30*a* as shown in FIG. 2. Upon completion of stacking all the sheets on the uppermost bin tray, the sheets are aligned by operating the sheet drawing means 61 and aligning means 63, and stapled with the stapler 62 on demand. The finished sheaf of sheets thus bound is taken out of the sheet intake space Si.

In a case that recorded sheets for a plurality of sets are given from the image forming device M, the sheets must be sorted in the apparatus 1 (sorting mode). In this sorting mode, the required number of sheets per page are continuously sent into the sheet storage apparatus 1. For instance, when five sheaves of ten-page sheets are required, five sheets of the first page are first discharged continuously, and thereafter, the following sheets from the second to tenth pages are sent out by five sheets from the image forming device 1.

Figure 7C:
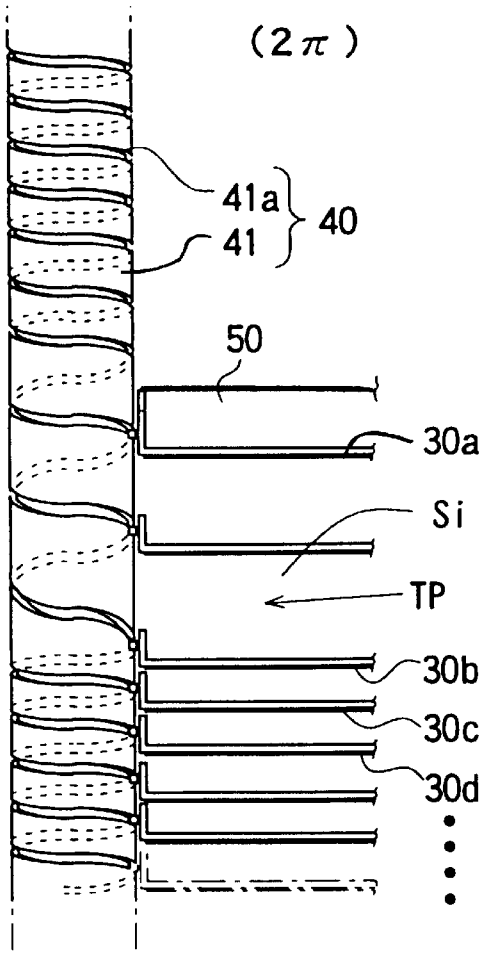
Figure 7B:
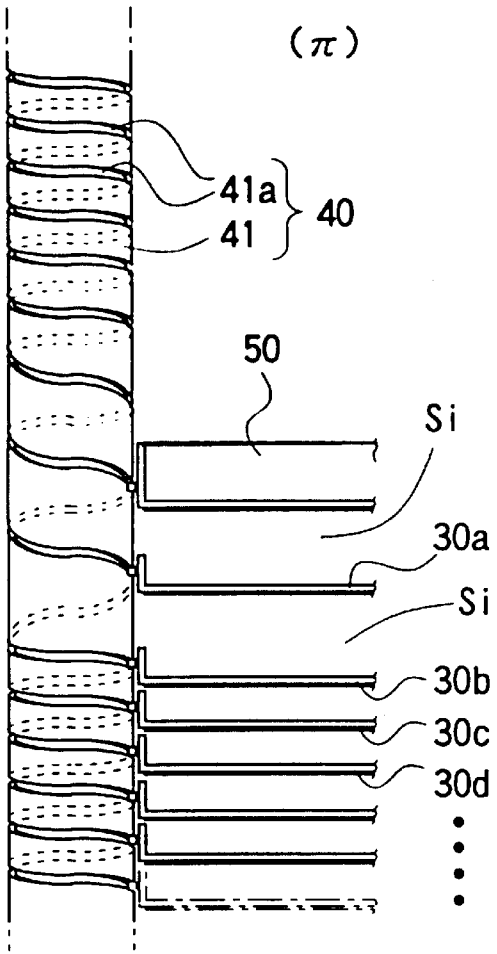
Figure 7A:
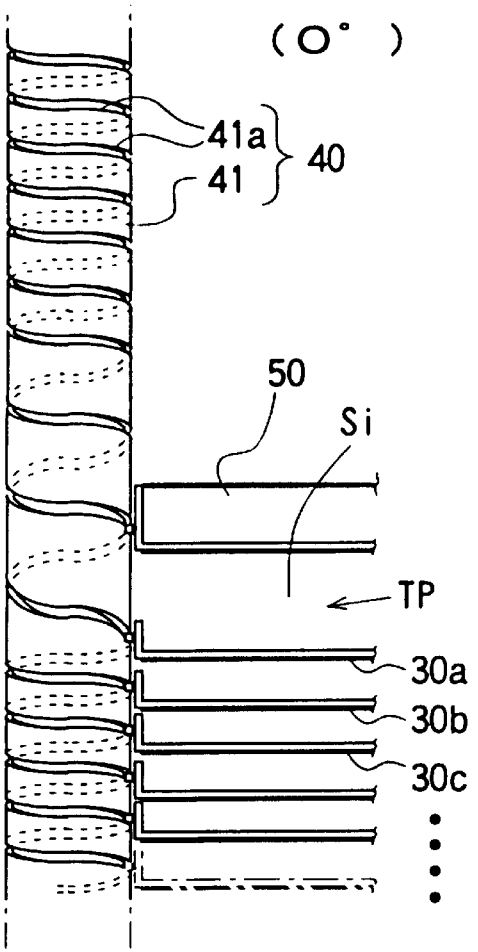
Figure 8A:
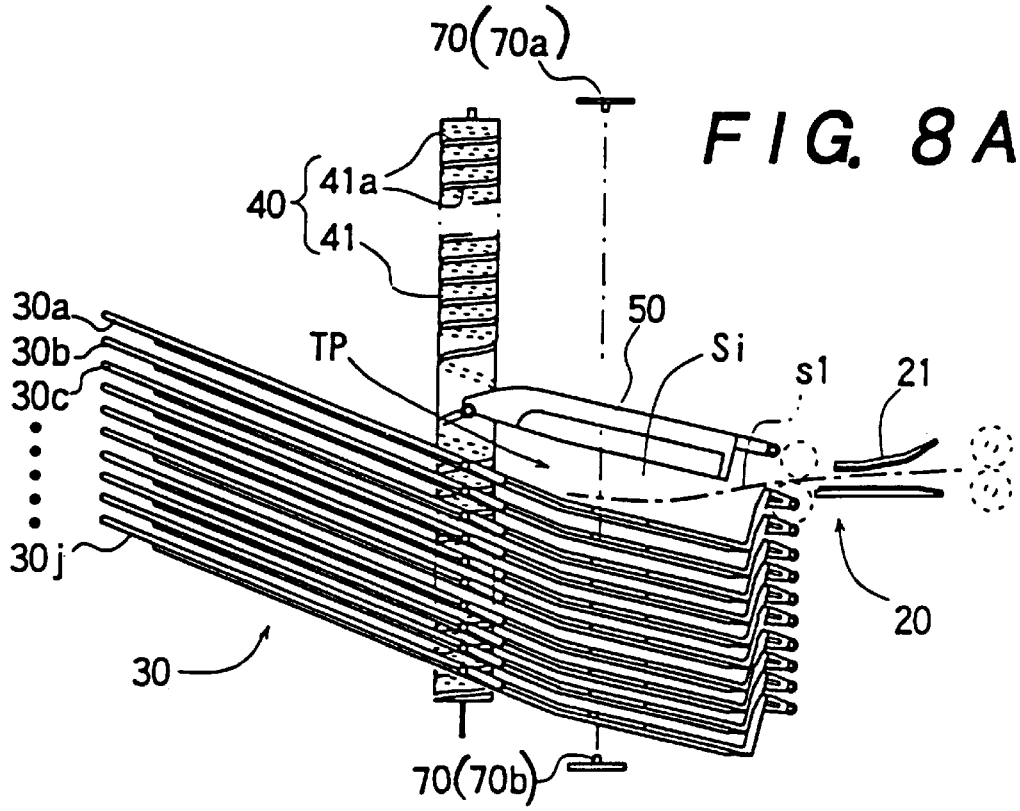
FIG. 8A and FIG. 8B are side views schematically showing the states in which the bin trays are driven in conjunction with the tray moving means when introducing a sheet.

Referring to FIG. 7A through FIG. 7F and FIGS. 8A and 8B, the first bin tray 30*a* first takes its position confronting the sheet intake position TP faced to the sheet intake rollers 22 as shown in FIG. 7A and FIG. 8A, while forming the sheet intake space Si thereon. In this state, the first page of the first set is introduced thereinto.

Figure 8B:
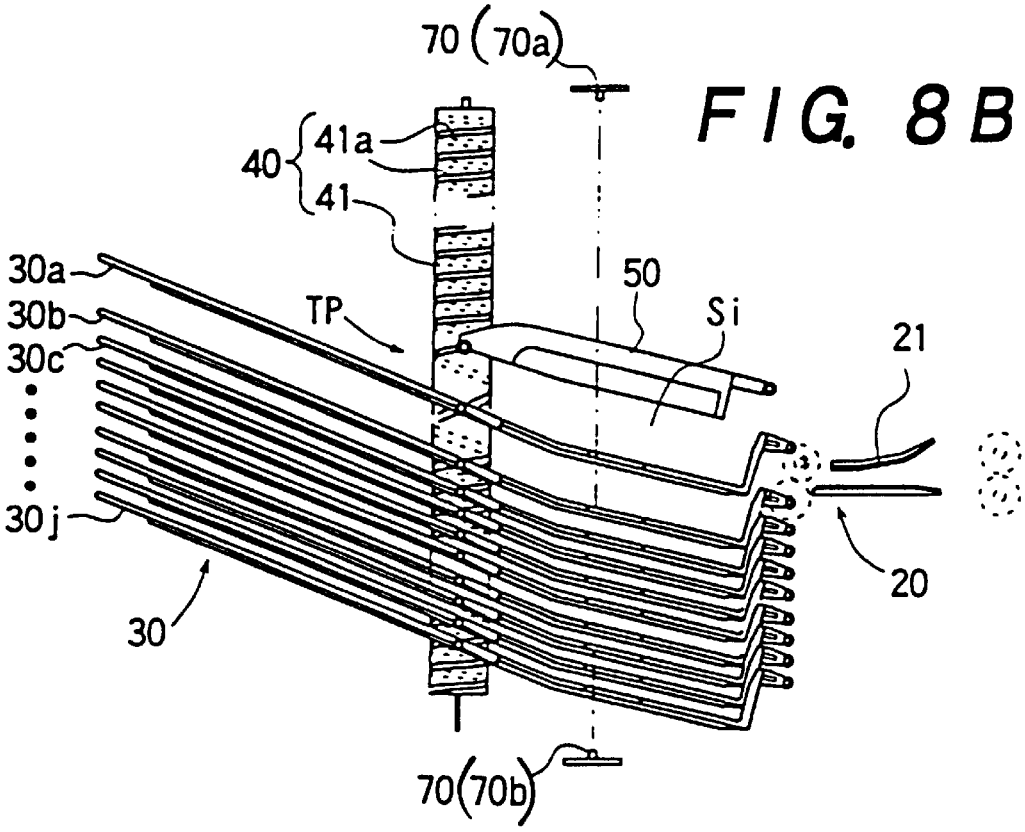

Next, the lead cams 41 are rotated one turn (for 360° degrees) into the state in which the second tray 30*b* is located at the sheet intake position TP to form the sheet intake space Si thereon as shown in FIG. 7C and FIG. 8B (2π rotation state). In this state, the first page of the second set is introduced into the sheet intake space formed on the second bin tray.

In the case of introducing the first page of the third set, the lead cams 41 are further rotated one turn into the state of FIG. 7E (4π rotation state) in which the sheet intake space Si for receiving the first page of the third set is formed on the third tray 30*c*. In the similar manner, the succeeding sheets of the required sets are consecutively introduced.

After introducing all the first pages, the lead cams 41 are reversed to return all the bin trays 30 to the initial state shown in FIG. 7A, and then, the sheets of the second pages are continuously introduced in the same manner as above.

When all the sheets are completely introduced into the sheet storage apparatus of the invention, the required number of sheaves of sheets are remained on the prescribed bin trays. Then, the lead cams in the initial state shown in FIG. 7A are rotated 180° into the state shown in FIG. 7B (π rotation state) or 540° into the state shown in FIG. 7D (3π rotation state) in which the intervals between the bin trays (sheet accommodating spaces) in the midsection of the lead cams are made wide practically, thereby to facilitate to take out the finished sheaves of sheets from the sheet accommodating spaces in the midsection of the lead cams. The finished sheaves of sheets left between the bin trays other than those in the midsection of the lead cams are also taken out with ease upon turning the lead cams 41 from the state shown in FIG. 7D to the state shown in FIG. 7F (5π rotation state) or further turning the lead cams so as to shift the lower bin trays to the midsection in the lead cams.

Although one example of obtaining the required sheaves of sheets was described above, the manner of operating the lead cams to shift the bin trays is by no means limitative and may be altered suitably according to the required number of sheaves of sheets and other conditions.

The sheet storage apparatus 1 of the invention further has a function of compressing the sheets stacked in the sheet accommodating space, in order to cure the sheets curled as the result of being processed with heat in the image forming device M. For example, if the sheet undergoes heating treatment for fixing a toner image with heat in the image forming device, the sheet is by and large curled or wraped due to heat. Consequently, the stack of sheets curled become bulky, and therefore, should be straightened.

Figure 9:
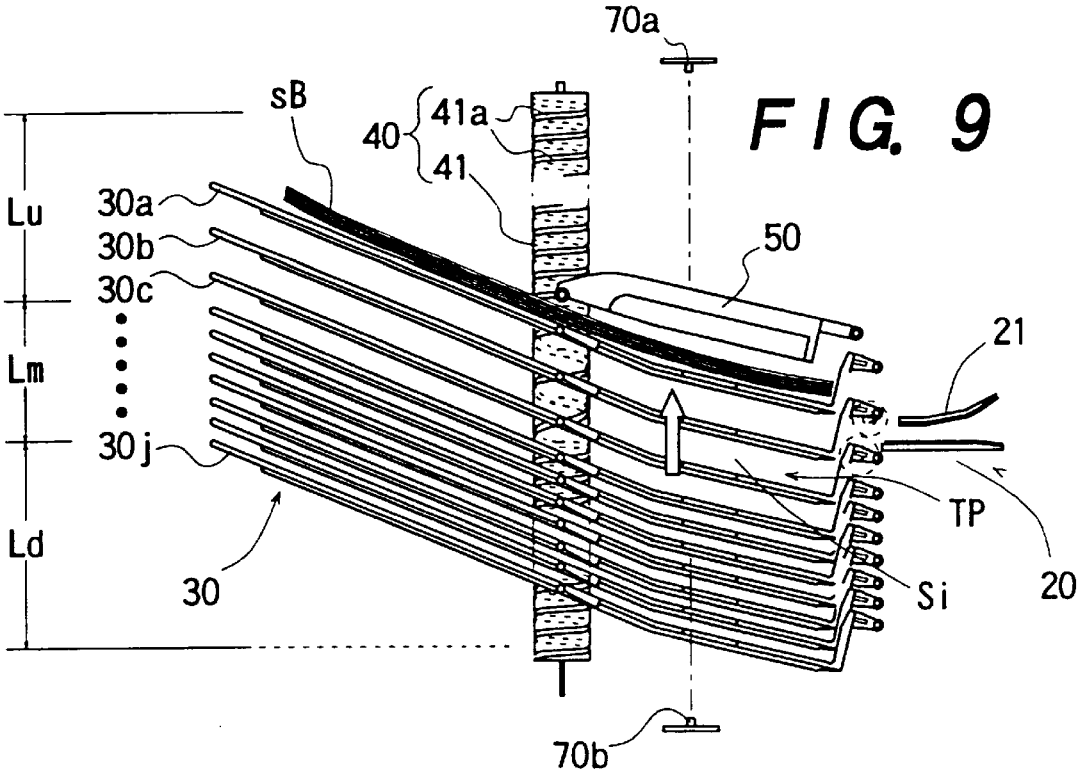
FIG. 9 is a side view illustrating the state in which the sheets stacked on the bin tray are compressed.

Accordingly, the sheet storage apparatus 1 of the invention serves to compress the sheets stacked on the bin tray. The compressing function is fulfilled in such a manner that, when the number of sheets sent into the sheet accommodating space defined between the first tray 30*a* and the space restriction member 50 by way of example comes to the prescribed number (e.g. 20 sheets), the first tray onto which the sheets are sent at the sheet intake position TP is shifted to the upper section Lu by rotating the lead cams 41, so that the sheet accommodating space in which the sheets to be straightened are stacked is made narrow. As a result, the stack of sheets sB on the first tray is compressed in the direction of thickness as shown in FIG. 9, thus to be reduced in bulk.

The timing of compressing or pressing the stack of sheets is controlled by counting the sheets passing through the sheet introduction means 20 by use of a sheet sensor 23 or detecting the height (thickness) of the sheets stacked on the bin tray by use of a sheet sensor 24 disposed at the sheet intake position TP. In either way, there may be predetermined the desired value in height or number of sheets stacked on the bin tray at which the sheets are compressed by operating the lead cams 41 to move vertically the bin tray holding the sheets thereon.

The compressing function brings about an effect of not only reducing the bulk of the sheets stacked, but also assuredly introducing the succeeding sheet from the image forming device into the sheet accommodating space without interference with the sheet or sheets already stacked on the bin tray. After compressing the sheets Bs stacked on the tray 30*a*, the tray 30*a* is again moved downward to the sheet intake position TP for receiving the sheets succeedingly fed from the image forming device.

Although the explanation concerned with the uppermost bin tray 30*a* was made above, the sheets stacked on the lower bin trays can as well be compressed by shifting the respective bin trays to the upper section Lu to make the sheet accommodating space narrow in the same manner as above.

To heighten the effect of compressing the sheets, it is desirable to let the space restriction member 50 and trays have an appropriate degree of resilience.

Strictly speaking, according to the invention, the sheet which is curled with heat or other possible causes during image processing in the image forming device can be appropriately cured in accordance with the state of the sheet curled.

That is to say, the sheet on which an image is formed or printed with toner and fixed with heat given by a heating roller at a final processing stage in the image forming device is generally curved along the curved surface of the heating roller.

Figure 10A:
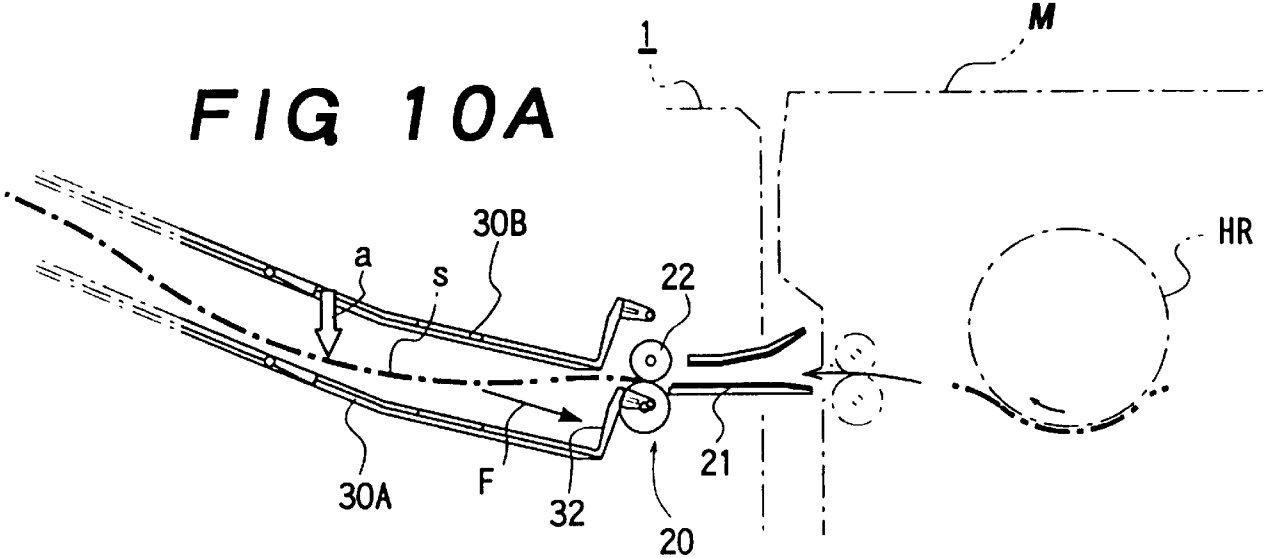
FIG. 10A and FIG. 10B are side views schematically showing the bin trays being moved in accordance with the conditions in which the sheets curled in different directions are handled.

To be more specific, when the sheet s is copied or printed on its upper surface with toner (face-up processing), the heating roller HR is brought into contact with the upper surface of the sheet as shown in FIG. 10A, as the result of which the sheet is concavely curled with its middle portion curved downward. Conversely, when the sheet s is copied or printed on its lower surface (face-down processing), the lower surface of the sheet comes into contact with the heating roller HR as shown in FIG. 10B, as the result of which the sheet is convexly curled with its middle portion curved upward.

Figure 10B:
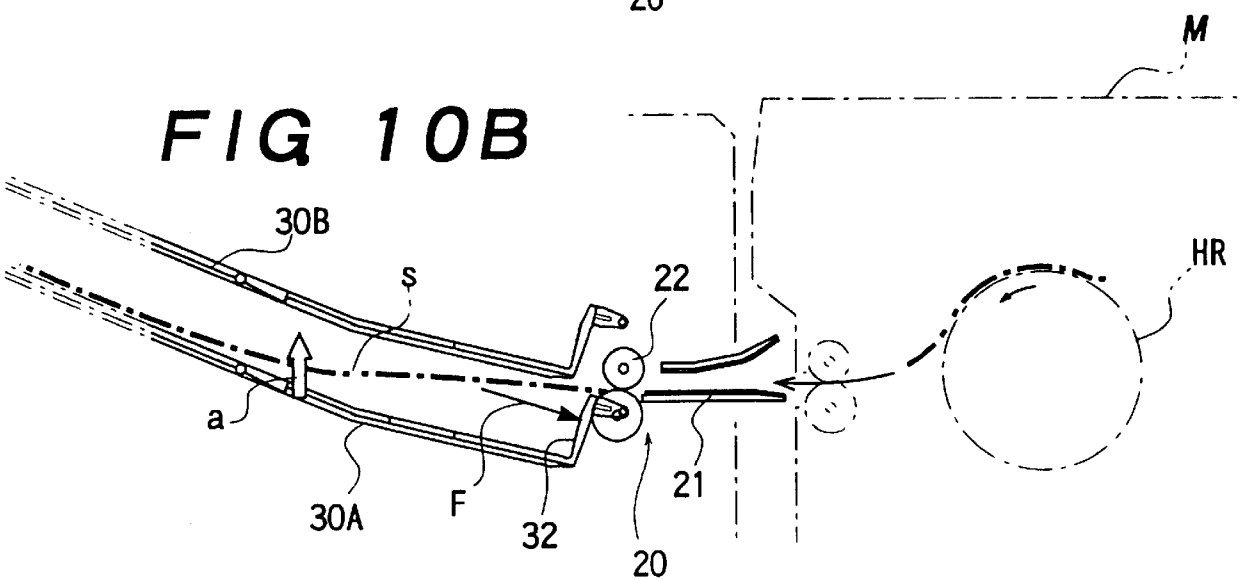

Furthermore, there are times when the tail end of the sheet given from the image forming device is caught by the sheet introduction means 20 as illustrated in FIG. 10A and FIG. 10B. When the bin tray is moved vertically as the tail end of the sheet is left on the sheet introduction means, it is possibly caught between the moving bin tray and the sheet introduction means 20, whereby the sheet is sometimes creased or torn, and in some cases, jammed disadvantageously.

The curled sheet which possibly causes the unfavorable state as noted above is not necessarily cured even by moving the bin tray in one direction invariably to press the sheet flat.

Accordingly, the sheet storage apparatus 1 of the invention further has a function of properly curing any curled sheet. That is, when the concavely curled sheet s as shown in FIG. 10A is sent from the image forming device into the sheet intake space Si, but partly left on the sheet induction means 20 as illustrated, the overhead bin tray 30B immediately above the tray 30A receiving the sheet s thereon is moved downward as indicated by the arrow a1. At this time, the sheet receiving tray 30A moves downward, but the overhead tray 30B moves faster than the tray 30A, thus causing the sheet intake space Si between the trays 30A and 30B to narrow in the lower section Ld defined by the lead cams. As a result, the sheet s in the narrowing space is pressed tightly and made flat by the trays 30A and 30B.

On the other hand, when the convexly curled sheet s as shown in FIG. 10B is sent into the sheet intake space Si, but partly left on the sheet induction means 20 as illustrated, the bin tray 30A receiving the sheet s thereon is moved upward as indicated by the arrow a2. At this time, the overhead tray 30B immediately above the sheet receiving bin tray 30A moves upward, but the sheet receiving tray 30A moves faster than the overhead tray 30B, thus causing the sheet intake space Si between the trays 30A and 30B to narrow in the upper section Lu defined by the lead cams. As a result, the sheet s in the narrowing space is pressed tightly and made flat by the trays 30A and 30B.

The sheet curing ways depicted in FIG. 10A and FIG. 10B are effective in eliminating curling of a relatively thin sheet. Thus, even when the tail end of the curled sheet fed from the image forming device is partly left on the sheet induction means 20 as illustrated, the curled sheet can be made to fall into the sheet intake space assuredly by the bin tray 30A or 30B in the direction in which the sheet is curved, consequently to prevent damaging or jamming of the sheet.

Figure 11A:
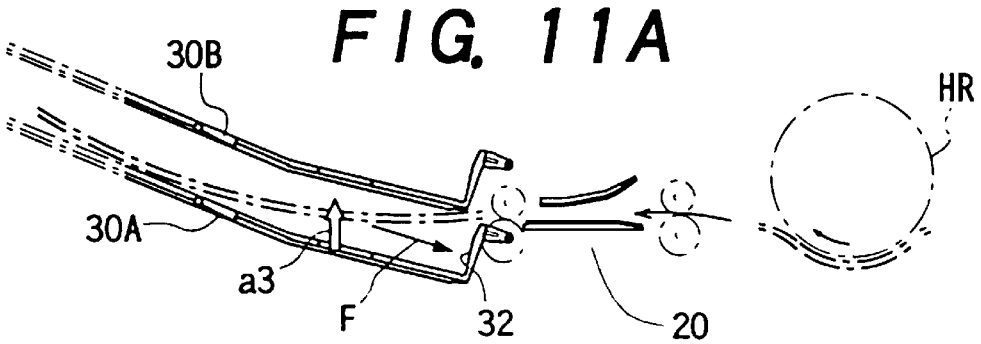
Figure 11B:
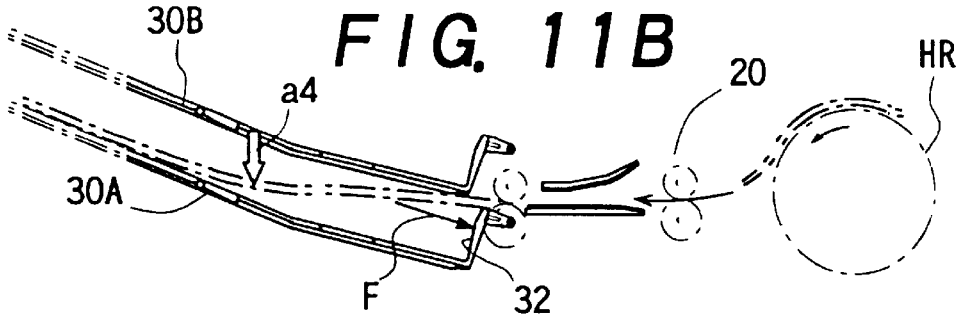

However, in case of handling a relatively thick sheet, the manner of curing the curled sheet is reversed. Namely, when the thick sheet having the upper surface printed is introduced into the sheet intake space Si, the sheet receiving tray 30A on which the sheet is stacked is moved upward as indicated by the arrow a3 in FIG. 11A. Conversely, when the thick sheet printed on its lower surface is introduced into the sheet intake space Si, the overhead tray 30B immediately above the sheet receiving tray 30A is moved downward as indicated by the arrow a4 in FIG. 11B. In either case, the thick sheet brings about an active force F of moderately urging the tail end of the sheet against the rear aligning step 32 of the bin tray, thus to effectively align the sheets stacked on the bin tray in the lengthwise direction.

Thus, according to the apparatus of the invention, the sheets stacked in the sheet accommodating space can be aligned with certainty and adequately cured in accordance with various conditions of the sheets and the states of the sheets to be dealt with in the face-up or face-down modes. Consequently, the permitted limit of accommodating the sheets in the sheet intake space can be remarkably increased.

The condition in which the sheet is curled and the thickness of the sheet to be handled can be automatically detected by using various kinds of sensors, but the manner of operating a controller necessary for the apparatus of the invention is not specifically limited. Namely, controlling parameters required for the apparatus may be manually determined.

As is apparent from the foregoing description, according to the sheet storage apparatus of this invention, since the sheet intake space defined on the bin tray located at the sheet intake position can be widened sufficiently by means of the lead cams with the spiral thread guide groove having irregular pitches for moving the bin trays vertically, the sheets fed from the image forming device can be stably and smoothly introduced into the sheet intake space. Furthermore, since the sheet accommodating spaces including the sheet intake space, which are formed between the adjacent bin trays arranged vertically, are equally made relatively wide by making the lead cams a half turn, the finished sheaves of sheets stacked in the sheet accommodating spaces can be easily taken out. Besides, since the sheet accommodating spaces which are open widely when introducing the sheets can be narrowed by shifting the bin trays to the upper or lower narrow-pitch section defined on the lead cams, in which the spiral grooves are made narrow in pitch so as to compress the sheets stacked in the accommodating spaces, a large number of sheets can be dealt with and assuredly introduced into the sheet intake space without interference with the sheet or sheets already stacked on the bin tray nor causing jamming.

Additionally, deformation such as curling of the sheet which is possibly caused by, for example, printing an image with heat in the image forming device can be effectively cured by shifting the bin tray receiving the deformed sheet to the upper or lower narrow-pitch section defined on the lead cams, whereby the sheet fed from the image forming device can be reliably introduced into the image intake space without hindrance.

Although the invention has been described in its preferred form with a certain degree of particularity, it is understood that the present disclosure of the preferred form has been changed in the details of construction and the combination and arrangement of parts may be resorted to without departing from the spirit and the scope of the invention as hereinafter claimed.

What is claimed is:

1. A sheet storage apparatus comprising:

a sheet introduction means for introducing sheets discharged from an image forming device to a sheet intake position one by one;

a plurality of bin trays for receiving the sheets from said image forming device, said bin trays being movable vertically in parallel and juxtaposed vertically;

a plurality of sheet accommodating spaces formed between said parallel bin trays;

a sheet intake space formed between said parallel bin trays confronting said intake position; and tray moving means for vertically moving said bin trays, said tray moving means including a pair of lead cams extending over an extent in which said bin trays are movable vertically, said extent including a midsection in which said sheet accommodating space located at said sheet intake position formed between said bin trays widens, and upper and lower sections in which said sheet accommodating space formed between said bin trays narrows, said bin trays being moved by operating said tray moving means with timing determined in accordance with an upward or downward convex curvature condition of sheets stacked, said condition being prescribed for a sheet to be dealt with, so as to narrow said sheet accommodating space defined on said bin tray located at said sheet intake position;

wherein the bin tray receiving the sheet fed from said image forming device and the bin tray immediately above said bin tray receiving the sheet are moved downward to narrow the sheet accommodating space formed therebetween when said sheet is concavely curled with its middle portion curved downward.

2. A sheet storage apparatus as claimed in claim 1, wherein said lead cams each have a spiral thread guide groove having variable pitch so as to define upper and lower sections in which the pitch of said guide groove is made relatively narrow, and a midsection in which the pitch of said guide groove is made relatively wide, said lead cams being rotatable, said bin trays being guided by said spiral thread guide groves in said lead cams so that said bin trays move vertically along said spiral thread guide grooves when said lead cams rotate.

3. A sheet storage apparatus as claimed in claim 1, wherein the bin tray receiving the sheet fed from said image forming device and the bin tray immediately above said bin tray receiving the sheet are moved upward to narrow the sheet accommodating space formed therebetween when said sheet is concavely curled with its middle portion curved downward, and the bin tray receiving the sheet fed from said image forming device and the bin tray immediately above said bin tray receiving the sheet are moved upward to narrow the sheet accommodating space formed therebetween when said sheet is convexly curled with its middle portion curved upward.

4. A sheet storage apparatus comprising;

a sheet introduction means for introducing sheets discharged from an image forming device to a sheet intake position one by one;

a plurality of bin trays for receiving the sheets from said image forming device, said bin trays being movable vertically in parallel and juxtaposed vertically;

a plurality of sheet accommodating spaces formed between said parallel bin trays;

a sheet intake space formed between said parallel bin trays confronting said intake position; and tray moving means for vertically said bin trays, said tray moving means including a pair of lead cams extending over an extent in which said bin trays are movable vertically, said extent including a midsection in which said sheet accommodating space located at said sheet intake position formed between said bin trays widens and upper and lower sections in which said sheet accommodating space formed between said bin trays narrows, said bin trays being moved by operating said tray moving means with timing determined in accordance with a condition of sheets stacked, said condition being prescribed for a sheet to be dealt with, so as to narrow said sheet accommodating space defined on said bin tray located at said sheet intake position, wherein the bin tray receiving the sheet fed from said image forming device and the bin tray immediately above said bin tray receiving the sheet are moved downward to narrow the sheet accommodating space formed therebetween when said sheet is relatively thick and convexly curled with its middle portion curved upward.

5. A sheet storage apparatus as claimed in claim 1, wherein the bin tray receiving the sheet fed from said image forming device and the bin tray immediately above said bin tray receiving the sheet are moved downward to narrow the sheet accommodating space formed therebetween when said sheet is relatively thick and concavely curled with its middle portion curved downward, and the bin tray receiving the sheet fed from said image forming device and the bin tray immediately above said bin tray receiving the sheet are moved downward to narrow the sheet accommodating space formed therebetween when said sheet is relatively thick and convexly curled with its middle portion curved upward.

6. A sheet storage apparatus comprising:

a sheet introduction means for introducing sheets discharged from an image forming device one by one;

at least one bin tray for receiving the sheets introduced by said sheet introducing means;

a space restriction member located at the other side opposite to said bin tray relative to sheets received by said bin tray, said bin tray and said space restriction member forming a sheet accommodating space therebetween; and moving means for moving one of said bin tray and said space restriction member toward the other to narrow said sheet accommodating space in accordance with a condition of said sheet received by said bin tray;

wherein said space restriction member is moved toward said bin tray to narrow said sheet accommodating space when said sheet is concavely curled with its middle portion curved toward said bin tray, and the bin tray receiving the sheet discharged from said image forming device is moved toward said space restriction member to narrow said sheet accommodating space when said sheet is convexly curled with its middle portion curved toward said space restriction member.

7. A sheet storage apparatus as claimed in claim 6, wherein said bin tray receiving the sheet discharged from said image forming device is moved toward said space restriction member to narrow said sheet accommodating space when said sheet is relatively thick and concavely curled with its middle portion curved toward said bin tray and said space restriction member is moved toward said bin tray receiving the sheet discharged from said image forming device to narrow said sheet accommodating space when said sheet is relatively thick and convexly curled with its middle portion curved toward said space restriction member.

* * * * *